US010729962B2

(12) United States Patent
Björkdahl

(10) Patent No.: US 10,729,962 B2
(45) Date of Patent: Aug. 4, 2020

(54) METHODS AND APPARATUS FOR INCREASING ACCURACY OF AIMING IN PUTTING A GOLF BALL

(71) Applicant: Rolf Björkdahl, Uddevalla (SE)

(72) Inventor: Rolf Björkdahl, Uddevalla (SE)

( * ) Notice: Subject to any disclaimer, the term of this patent is extended or adjusted under 35 U.S.C. 154(b) by 0 days.

(21) Appl. No.: 15/983,631

(22) Filed: May 18, 2018

(65) Prior Publication Data

US 2018/0345112 A1 Dec. 6, 2018

(30) Foreign Application Priority Data

May 30, 2017 (SE) ..... 1750675

(51) Int. Cl.

| | |
|---|---|
| ***A63B 69/36*** | (2006.01) |
| ***A63B 57/00*** | (2015.01) |
| *A63B 71/06* | (2006.01) |
| *A63B 45/02* | (2006.01) |

(52) U.S. Cl.

CPC ..... *A63B 69/3676* (2013.01); *A63B 57/00* (2013.01); *A63B 45/02* (2013.01); *A63B 2071/0694* (2013.01)

(58) Field of Classification Search

CPC ..... A63B 69/3676; A63B 57/00; A63B 2071/0694; A63B 57/353

See application file for complete search history.

(56) References Cited

U.S. PATENT DOCUMENTS

| | | | | |
|---|---|---|---|---|
| 3,934,882 A | | 1/1976 | Whittaker | |
| 4,209,172 A | * | 6/1980 | Yamamoto | A63B 69/3685 473/200 |
| 4,235,440 A | * | 11/1980 | Hinckley | A63B 69/36 473/257 |
| 4,521,018 A | * | 6/1985 | Cotchonis | A63B 57/353 473/406 |
| 5,067,719 A | * | 11/1991 | Mook | A63B 43/008 40/327 |
| 5,205,559 A | * | 4/1993 | Plopper | A63B 63/00 273/127 B |
| 5,294,124 A | * | 3/1994 | Florian | A63B 24/0003 359/838 |
| 5,356,133 A | * | 10/1994 | Bellagamba | A63B 57/353 473/406 |

(Continued)

FOREIGN PATENT DOCUMENTS

| | | | | |
|---|---|---|---|---|
| CA | 2507408 A1 | * | 11/2006 | A63B 47/02 |
| DE | 102014000181 A1 | * | 7/2015 | A63B 57/353 |
| WO | WO 0018478 A1 | * | 4/2000 | A63B 57/207 |

*Primary Examiner* — Steven B Wong

(74) *Attorney, Agent, or Firm* — Cantor Colburn LLP

(57) ABSTRACT

A method and apparatus for increasing the accuracy of aiming in connection with putting a ball on a green of a golf course. A main part of the aiming aid is placed behind the ball so that the center of the ball is situated in a real or imaginary center of a recess, which can be half-circular. An alignment mark on the aiming aid is directed toward an intended target, such as the hole, and aligned with a marking, such as a text line, drawn line, or other marking, on the ball aligned with or at an angle to a perpendicular end edge of the aiming aid or a marked perpendicular line on the aiming aid. The aiming aid is removed before putting with the straight face of a club parallel to the marking on the ball.

2 Claims, 2 Drawing Sheets

(56) References Cited

U.S. PATENT DOCUMENTS

| | | | | | |
|---|---|---|---|---|---|
| 5,713,799 | A * | 2/1998 | Balmat | A63B 43/008 | 40/327 |
| D428,954 | S * | 8/2000 | Tate | D21/793 | |
| 6,840,870 | B1 | 1/2005 | Froggatte | | |
| D501,900 | S * | 2/2005 | Gammon, Jr. | D21/708 | |
| D583,893 | S * | 12/2008 | Ruff | D21/794 | |
| D614,253 | S * | 4/2010 | Hadley | D21/791 | |
| D669,551 | S * | 10/2012 | Perez | D21/794 | |
| D826,355 | S * | 8/2018 | Kenny | D21/793 | |
| D828,887 | S * | 9/2018 | Kenny | D21/793 | |
| 2009/0305817 | A1* | 12/2009 | Cameron | A63B 59/50 | 473/406 |
| 2009/0305818 | A1* | 12/2009 | Cameron | A63B 57/50 | 473/406 |
| 2010/0035699 | A1* | 2/2010 | Sorenson | A63B 69/3676 | 473/278 |
| 2010/0222161 | A1* | 9/2010 | Williams | A63B 69/3676 | 473/407 |
| 2011/0053711 | A1* | 3/2011 | Trafford | A63B 69/3676 | 473/406 |
| 2013/0203521 | A1* | 8/2013 | Freund | A63B 69/3676 | 473/257 |
| 2013/0260920 | A1* | 10/2013 | Goldsmith | A63B 57/353 | 473/404 |
| 2015/0148144 | A1 | 5/2015 | Freund | | |
| 2017/0056747 | A1* | 3/2017 | Merwin | A63B 69/3676 | |

* cited by examiner

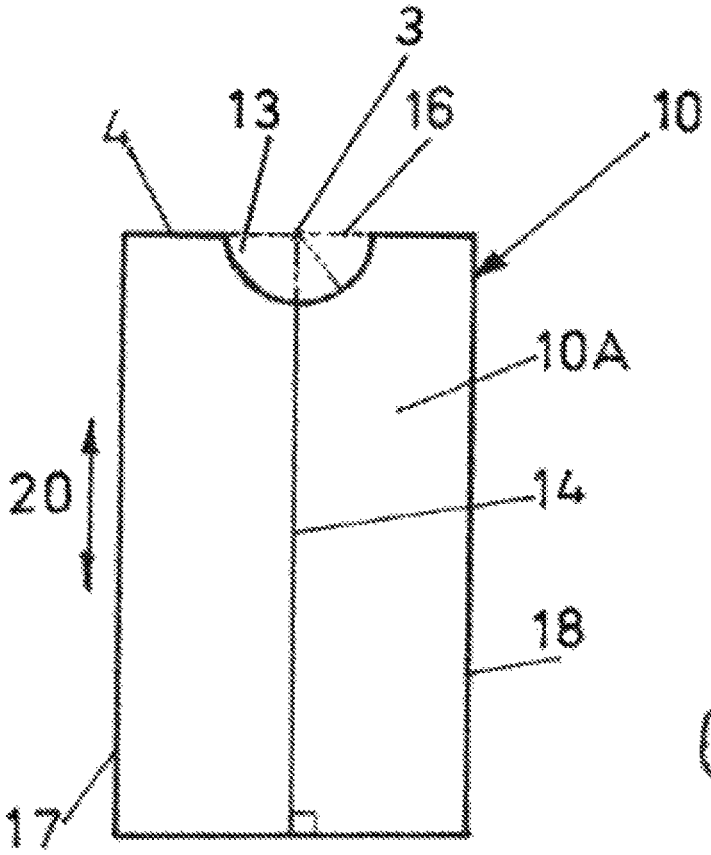
Fig. 1
Fig. 2
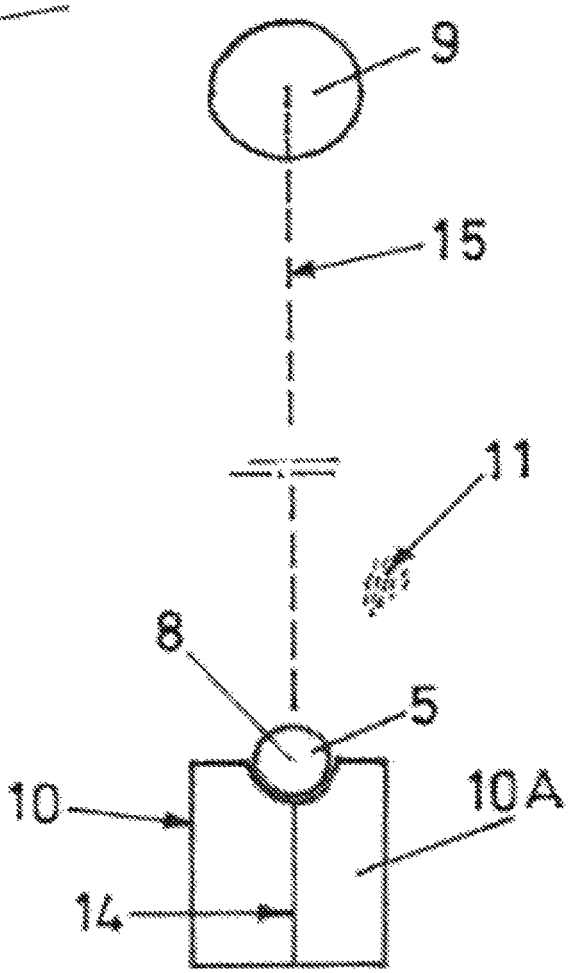

METHODS AND APPARATUS FOR INCREASING ACCURACY OF AIMING IN PUTTING A GOLF BALL

This application claims priority to Swedish Patent Application No. 1750675-9 that was filed on 30 May 2017 and that is incorporated here by reference.

BACKGROUND

This invention concerns a method of facilitating aiming in connection with putting on a green of a golf course using an aiming aid as well as an aiming aid for facilitating aiming in connection with putting on a green of a golf course.

Golf (the game) consists of the golf player (the player) striking the golf ball (the ball) from a tee to the respective hole using as few strokes as possible. The game consists of both longer and shorter strokes.

The very shortest strokes, so-called putts, take place on the closely cut parts of the golf course which are called greens. Putting presupposes exact precision. Exact precision presupposes that the face of the putter is placed perpendicularly to the target. The slope and nature in other respects of a green determine if the target consists of the center of the hole or somewhere else.

U.S. Pat. No. 3,934,882A discloses an aiming plate that is placed between the ball and the hole and which aiming plate remains in place during the period of the swing. It seems to be intended for the golfer's posture, so that the head of the golfer can be seen in the reflecting top surface of the aiming plate.

US Patent Application Publication US 2015/148144 A1 discloses a support plate for putting training that is placed behind a ball and seems to remain on the grass upon putting.

U.S. Pat. No. 6,840,870B1 discloses a putting aid that is nailed in place in the ground. The aim seems to be intended to limit the backswing of the putter club.

There may be problems to properly align the putter so that the effective straight impact surface thereof is placed substantially perpendicular to the direction of the hole into which it is desired to putt the ball on the green.

The face of the putter has to be placed exactly perpendicular to the target. Otherwise the ball will, when it is stroked, miss the target.

Nevertheless, it is impossible for a player to know that the face of the putter is placed perpendicular to the target. Thus, the player can never know for certain that he or she aims exactly at the target.

SUMMARY

The present aiming aid makes it possible for the player to know for certain that he or she always places the face of the putter perpendicular to the target. Thus, the player can for certain know that he or she always aims at the target.

An exemplary aiming aid comprises, for instance, a rectangular plate having four perpendicular corners with a recessed semicircle, the center of which coincides with the point where an aiming line meets a short side of the plate.

Along the center of the rectangular long sides, for instance, the aiming line runs. The aiming line is perpendicular to the two short sides. At one short side, a semicircle with the radius is recessed. The diameter of the semicircle is approximately the diameter of a golf ball. The imaginary center of the recessed semicircle coincides with the point where the aiming line meets that short side.

First, the rules of golf allow that a player, in connection with putting on a green, by marker of varying kind, for instance a coin, etc., may mark, lift, and then replace the ball in exactly the same location from where it is lifted.

Second, the player, by a suitably available aid, such as a pencil, marks a circular line on the outer circumference of the ball, a so-called ball line, or lets a line of printed text on the ball constitute a ball line.

Thus, an object of this invention is to, by simple and allowable ways and means, solve problems of aiming properly upon putting.

This and other objects are achieved by a method according to this invention, which includes placing an aiming aid on the grass behind the ball, so that the center of the ball is situated in the real or imaginary center of the circular half recess of the aiming aid, and that the aiming aid is aligned with the alignment mark of the aiming aid directed toward the position of the intended target using a text line, drawn line, or other marking on the ball aligned with or at an angle to the perpendicular end edge of the aiming aid or marked perpendicular line on the aiming aid. After that, the aiming aid is removed before putting with the straight face of the club parallel to the marking on the ball.

In addition, the invention comprises realizing the method with an aiming aid that includes a plate having a recess fitting a part of the circumference of a golf ball therein, and an alignment mark arranged on the aiming aid behind the recess pointing in the marker's intended length extension as well. The aiming aid also has an end edge that is perpendicular to the alignment mark or to a marked perpendicular line on the marker co-operatable with a text line, drawn line, or other marking on the golf ball.

BRIEF DESCRIPTION OF THE DRAWINGS

The invention is described below in the form of a preferred embodiment example, with reference to the accompanying drawings, in which:

FIG. 1 shows a planar view of an aiming aid;

FIG. 2 schematically shows the aiming aid in effective marking and alignment position, as seen from above;

DETAILED DESCRIPTION

Figure 3:
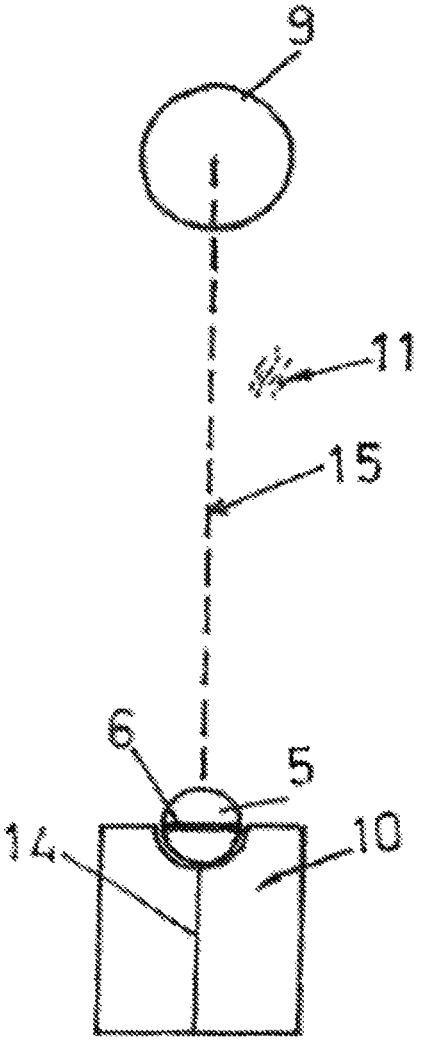
FIG. 3 shows the aiming aid with a golf ball in aligned position prepared for putting.

A method of increasing the accuracy of aiming in connection with the putting of a golf ball on a green of a golf course using an aiming aid 10 involves that a main part 10A of the aiming aid 10 is placed behind a ball 5 as a marker, so that the center of the ball is situated in the real or imaginary center of a circular recess 13 of the aiming aid 10. Next, the aiming aid 10 is aligned with an aiming line 14 of the aiming aid 10 directed along a path 15 toward the position of the intended hole 9 or other target with a ball line 6, such as a text line, drawn line, or other marking, on the ball 5 aligned with or at an angle to a perpendicular end edge 4 of the aiming aid 10 or a marked perpendicular line on the aiming aid 10, after which the aiming aid 10 is removed before putting with the straight face 7 of the club parallel to the alignment mark 6 on the ball.

The aiming aid 10 is placed behind the ball 5, for example before removing the ball for cleaning, so that the center 8 of the ball is situated in the imaginary center 3 of the recess 13. The aiming line 14 is directed toward the hole or other target, whereby the player knows that the short side 4 of the aiming aid is perpendicular to the hole 9. See FIG. 2.

Next, the ball 5 is replaced after wiping, or after another player has putted his/her ball, in the imaginary center 3 of the recess 13 so that the ball line 6 coincides with or is at least parallel to the short side 4 of the aiming aid 10, after which the aiming aid is removed. The player knows in that connection that the ball line 6 is perpendicular to the hole 9 or other target, aligned according to the shape of the terrain of green 11.

The player next places the face 7 of the player's putter parallel to the ball line 6 (see FIGS. 3 and 4), whereby the player knows that the face 7 of the putter is perpendicular to the hole 9 or other aimed-at target and the player accordingly knows for certain that he or she aims exactly at an intended target, e.g., the hole 9.

Figure 4:
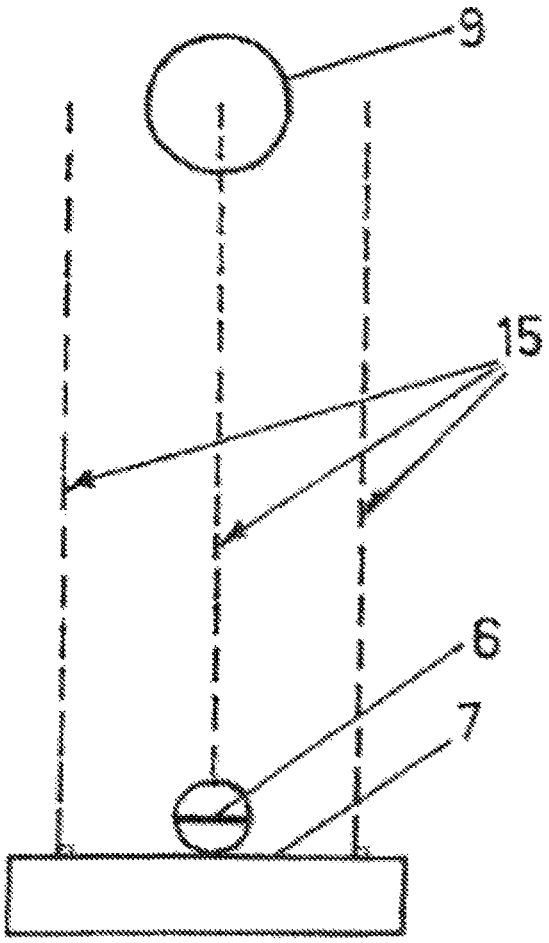
FIG. 4 shows ball and putter in intended striking position toward a hole.
Figure 5:
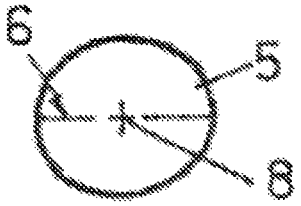
FIG. 5 shows a golf ball with marking on as well as shown center.

An aiming aid 10 for increasing the accuracy of aiming in connection with the putting of golf ball 5 on the green 11 of a golf course is shown in FIGS. 1-3 according to an embodiment example and comprises a plate 10A having a partly or semi-circular recess 13 fitting to a part of the circumference of a golf ball therein. An alignment mark or aiming line 14 is arranged on the aiming aid 10 behind the recess 13 and pointing in a length extension 20 of the aiming aid. The aiming aid 10 has a front short side or edge 4 which is perpendicular to the alignment mark 14 or to a marked perpendicular line, not shown, on the aiming aid 10. In use, a golfer uses the short side 4 with a ball line 6, such as a text line, drawn line, or other marking, on the golf ball 5. The plate 10A can include a sheet of plastic, wood, metal, or other easily machinable and weatherproof material, with the recess 13 advantageously centered at the front end edge 4 of the plate 10A.

As shown in the drawings, the recess 13 is a semicircular recess in the front end 4 of the plate, with a diameter 16 that coincides with the front end edge 4 of the plate.

The plate can be rectangular or another suitable shape with an alignment mark 14 formed in line with the center of the plate between long sides 17, 18 of the plate, which as seen in this embodiment are parallel, and thereby act as supplementary aiming aids. The alignment mark line 14 is in line straight through the center 3 of the semicircular recess 13.

The features, functions, and advantages of this invention should be clearly understood from this description and drawings but the invention is naturally not limited to the embodiments described above and shown in the accompanying drawings. Modifications are feasible, particularly as for the nature of the different parts, or by using an equivalent technique, without departing from the scope of the invention, which is defined by the following claims.

What is claimed is:

1. A method of increasing accuracy of aiming in putting a golf ball on a green of a golf course, comprising:

placing a main part of an aiming aid on the green behind the golf ball such that a center of the golf ball is situated substantially at a recess center defined by a recess of the aiming aid;

orienting an alignment mark of the aiming aid to point toward an intended target defining a path to the intended target and such that a short side of the aiming aid is oriented perpendicular to the path to the intended target;

aligning the alignment mark and a text line, drawn line or other marking on the golf ball aligned with or at an angle to a perpendicular edge or marking of the aiming aid;

removing the aiming aid from the green before putting the golf ball; and orienting a straight face of a putter parallel to the text line, drawn line, or other marking on the golf ball after removal of the aiming aid from the green and prior to putting the golf ball, whereby when the aiming aid is removed from the green prior to putting, the text line, drawn line, or other marking on the golf ball is oriented in a perpendicular relationship with the path to the intended target such that when the straight face of the putter is visually aligned parallel to the text line, drawn line, or other marking on the golf ball, then the straight face of the putter is in perpendicular alignment with the path to the intended target and a stroke of the putter being placed in a direction substantially parallel to the alignment mark and such that the putter is aimed at the intended target.

2. The method of claim 1, wherein the golf ball is situated in the recess center of the recessed semicircle so that a marking on the ball coincides with the short side, after which the aiming aid is removed, whereby the marking on the ball is perpendicular to the path to the intended target.

* * * * *